US007906010B2

(12) United States Patent
Keusenkothen et al.

(10) Patent No.: US 7,906,010 B2
(45) Date of Patent: Mar. 15, 2011

(54) USE OF STEAM CRACKED TAR

(75) Inventors: Paul F. Keusenkothen, Houston, TX (US); Alok Srivastava, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 1177 days.

(21) Appl. No.: 11/331,945

(22) Filed: Jan. 13, 2006

(65) Prior Publication Data

US 2007/0163921 A1 Jul. 19, 2007

(51) Int. Cl.
*C10C 3/00* (2006.01)

(52) U.S. Cl. ..... 208/22; 208/6; 208/23; 208/44

(58) Field of Classification Search ..... None
See application file for complete search history.

(56) References Cited

U.S. PATENT DOCUMENTS

| | | | | |
|---|---|---|---|---|
| 1,823,594 | A | 9/1931 | Diggs | |
| 3,622,502 | A | 11/1971 | Mason et al. | 208/112 |
| 3,691,058 | A | 9/1972 | Hamner et al. | 208/73 |
| 3,707,459 | A | 12/1972 | Mason et al. | 208/76 |
| 4,207,168 | A | 6/1980 | Simone | 208/86 |
| 4,446,002 | A | 5/1984 | Siegmund | 208/23 |
| 5,215,649 | A | 6/1993 | Grenoble et al. | 208/95 |
| 5,443,715 | A | 8/1995 | Grenoble et al. | 208/95 |
| 2004/0004022 | A1 | 1/2004 | Stell et al. | 208/106 |
| 2004/0004027 | A1 | 1/2004 | Spicer et al. | 208/130 |
| 2004/0004028 | A1 | 1/2004 | Stell et al. | 208/130 |
| 2005/0261530 | A1 | 11/2005 | Stell et al. | 585/648 |
| 2005/0261531 | A1 | 11/2005 | Stell et al. | 585/648 |
| 2005/0261532 | A1 | 11/2005 | Stell et al. | 585/648 |
| 2005/0261534 | A1 | 11/2005 | Stell et al. | 585/648 |
| 2005/0261536 | A1 | 11/2005 | Stell et al. | 585/648 |
| 2005/0261537 | A1 | 11/2005 | Stell et al. | 585/648 |
| 2005/0261538 | A1 | 11/2005 | Stell | 585/648 |

FOREIGN PATENT DOCUMENTS

| | | |
|---|---|---|
| DE | 43 08 507 | 9/1993 |
| JP | 58 149991 | 9/1983 |
| WO | WO 91/13951 | 9/1991 |
| WO | WO 91/17230 | 11/1991 |

*Primary Examiner* — Tam M Nguyen

(57) ABSTRACT

The invention relates to the use of steam cracked tar with the bottoms product of a flash drum integrated with a pyrolysis furnace. In embodiments, the steam cracked tar is added to fuel oil.

15 Claims, No Drawings

USE OF STEAM CRACKED TAR

FIELD OF THE INVENTION

The invention relates to a method for improving the solubility of steam cracked tar in useful compositions. In an embodiment, the upgraded steam cracked tar is added to fuel oil.

BACKGROUND OF THE INVENTION

Steam cracking, also referred to as pyrolysis, has long been used to crack various hydrocarbon feed stocks into olefins, preferably light olefins such as ethylene, propylene, and butenes. Conventional steam cracking utilizes a pyrolysis furnace that has two main sections: a convection section and a radiant section. In the conventional pyrolysis furnace, the hydrocarbon feedstock enters the convection section of the furnace as a liquid (except for light feed stocks which enter as a vapor) wherein it is heated and vaporized by indirect contact with hot flue gas from the radiant section and optionally by direct contact with steam. The vaporized feedstock and steam mixture (if present) is then introduced through crossover piping into the radiant section where the cracking takes place. The resulting products comprising olefins leave the pyrolysis furnace for further downstream processing.

Pyrolysis involves heating the feedstock sufficiently to cause thermal decomposition of the larger molecules. Among the valuable and desirable products include light olefins such as ethylene, propylene, and butylenes. The pyrolysis process, however, also produces molecules that tend to combine to form high molecular weight materials known as steam cracked tar or steam cracker tar, hereinafter referred to as "SCT". These are among the least valuable products obtained from the effluent of a pyrolysis furnace. In general, feed stocks containing higher boiling materials ("heavy feeds") tend to produce greater quantities of SCT.

SCT is among the least desirable of the products of pyrolysis since it finds few uses. SCT tends to be incompatible with other "virgin" (meaning it has not undergone any hydrocarbon conversion process such as FCC or steam cracking) products of the refinery pipestill upstream from the steam cracker. At least one reason for such incompatibility is the presence of asphaltenes. Asphaltenes are very high in molecular weight and precipitate out when blended in even insignificant amounts into other materials, such as fuel oil streams.

One way to avoid production of SCT is to limit conversion of the pyrolysis feed, but this also reduces the amount of valuable products such as light olefins. Another solution is to "flux" or dilute SCT with stocks that do not contain asphaltenes, but this also requires the use of products that find higher economic value in other uses.

In U.S. Pat. No. 4,446,002, the precipitation of sediment in unconverted residuum obtained from a virgin residuum conversion process is taught to be suppressed by blending the unconverted residuum with an effective amount of a virgin residuum having an asphaltene content of at least about 8 wt % of the virgin residuum at a temperature sufficient to maintain both residuum components at a viscosity of no greater than about 100 cSt (centistokes) during blending. Virgin residuum is the bottoms product of the atmospheric distillation of petroleum crude oil at temperatures of about 357 to 385° C.

In U.S. Pat. No. 5,443,715, steam cracked tar is upgraded by mixing with a "hydrogen donor", preferably hydro treated steam cracked tar, at or downstream of quenching of the effluent of a gas oil steam cracker furnace. In this regard, see also U.S. Pat. Nos. 5,215,649; and 3,707,459; and WO 9117230.

Other references of interest include U.S. Pat. Nos. 3,622,502; 3,691,058; 4,207,168; 4,264,334; WO 91/13951; DE 4308507; and JP 58-149991.

There has recently been described a process wherein a pyrolysis furnace feedstock is provided to the convection section of the pyrolysis furnace, whereby at least a portion of the feedstock is vaporized, followed subsequently by passing the at least partially vaporized feedstock, optionally with steam, to a flash drum, wherein a vapor phase and liquid phase are separated. The vapor phase is fed to the radiant section of a pyrolysis furnace, and products, including desirable light olefins, are obtained as effluent of the furnace. The liquid phase or bottoms product of the flash drum contains substantially all of the asphaltenes (if present) in the feedstock. Such processes and apparatus therefore are described in US Applications 2004/0004022; 20040004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538.

The present inventors have surprisingly discovered that SCT is highly compatible with the flash drum bottoms product in the aforementioned processes, and the two materials may be blended to produce a composition having higher solubility in various petroleum products, particularly fuel oils, e.g., heavy fuel oils or Bunker fuels.

SUMMARY OF THE INVENTION

The invention is direct to a process wherein the liquid or bottoms product of a flash drum downstream from the convection section inlet of a pyrolysis furnace and upstream of the crossover piping to the radiant section of said pyrolysis furnace is obtained and mixed with steam cracked tar (SCT).

In preferred embodiments, the mixture of said bottoms product and said SCT is subsequently mixed with fuel oils and/or Bunker fuels (and optionally flux).

The invention is also directed to a composition comprising steam cracked tar (SCT) and the liquid or bottoms product of a flash drum integrated with a pyrolysis furnace.

In any of the aforementioned embodiments, SCT is optionally fluxed.

In any of the aforementioned embodiments, the SCT is optionally mixed with steam cracked gas oil (SCGO) and/or atmospheric gas oil (AGO).

In preferred embodiments of any of the aforementioned embodiments, the composition of the invention further comprises fuel oils, such as heavy fuel oils and/or Bunker fuels.

It is an object of the invention to compatibilize SCT for economically useful purposes, such as for use in fuels for diesel engines in large machinery.

These and other objects, features, and advantages will become apparent as reference is made to the following detailed description, preferred embodiments, examples, and appended claims.

DETAILED DESCRIPTION

The invention is direct to a process wherein the liquid or bottoms product of a flash drum downstream from the convection section inlet of a pyrolysis furnace and upstream of the crossover piping to the radiant section of said pyrolysis furnace is obtained and mixed with SCT. Liquid product and bottoms products are synonymous with regard to the flash drum components. As used herein, the phrase "bottoms product of a flash drum integrated with a (or "said") pyrolysis furnace" will mean "liquid or bottoms product of a flash drum downstream from the convection section inlet of a pyrolysis furnace and upstream of the crossover piping to the radiant section of said pyrolysis furnace" for the sake of brevity.

The term "pyrolysis furnace" is used herein to be synonymous with the term "steam cracker". It is also known in the art as a "thermal pyrolysis furnace". Steam, although optional, is typically added inter alia to reduce hydrocarbon partial pressure, to control residence time, and to minimize coke formation. In preferred embodiments of the present invention, the steam may be superheated, such as in the convection section of the pyrolysis unit, and/or the steam may be sour or treated process steam.

According to the present invention, a feed stream is provided to the inlet of a convection section of a pyrolysis unit, wherein it is heated so that at least a portion of the feed stream is in the vapor phase. Steam is optionally but preferably added in this section and mixed with the feed stream. The heated feed stream with optional steam and comprising a vapor phase and a liquid phase is then flashed in a flash drum to drop out the heaviest fraction (e.g., asphaltenes), and further processing the overheads from the flash drum, through crossover piping into the radiant section of a pyrolysis unit.

One of the advantages of having a flash drum downstream of the convection section inlet and upstream of the crossover piping to the radiant section is that it increases the feed streams available to be used directly, without pretreatment, as feed to a pyrolysis furnace. Thus, crude oil, even high naphthenic acid containing crude oil and fractions thereof, may be used directly as feed.

The terms "flash drum", "flash pot", "knock-out drum" and knock-out pot" are used interchangeably herein; they are per se well-known in the art. In a preferred embodiment, the composition of the vapor phase leaving the flash drum is substantially the same as the composition of the vapor phase entering the flash drum, and likewise the composition of the liquid phase leaving the flash drum is substantially the same as the composition of the liquid phase entering the flash drum, i.e., the separation in the flash drum consists essentially of a physical separation of the two phases entering the drum.

The preferred flash drum and the of the flash drum with pyrolysis units have previously been described in U.S. Patent Application Publication Nos. 2004/0004022; 20040004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538.

Another preferred apparatus effective as a flash drum for purposes of the present invention is described in U.S. Pat. No. 6,632,351 as a "vapor/liquid separator".

In the process of the present invention, the flash drum preferably operates at a temperature of from about 800° F. (about 425° C.) to about 850° F. (about 455° C.).

Surprisingly, it has also been discovered by the present invention that 1000° F.+ (about 538° C. and greater) vacuum tower resid fractions from the petroleum refining pipestill is an equivalent of the liquid or bottoms product of the aforementioned flash drum. Thus, this material may also be used alone or mixed with said liquid or bottoms product, provided it is derived from crudes or fractions there of having a low pour point as described in more detail below.

In the present invention, feed streams may comprise any crude oil or fraction thereof, however it has been found that crudes having Pour Points greater than about 15° C. do not provide integrated flash drum bottoms product that make good solvents for tar asphaltenes and therefore must be used in very high proportions or require too much fluxing to be beneficially useful. Preferred feeds are low sulfur (e.g, maximum sulfur content of less than 2.0 wt % or 1.5 wt % or 1.0 wt % or less than 1.0 wt % S), low Pour Point, even more preferably medium weight crudes that are non-waxy. In another embodiment, the preferred crudes or fractions thereof having a Pour Point of about <5° C.

Pour Points as used herein are determined by ASTM D5853 for whole crude and by ASTM D97 for crude fractions. Kinematic viscosity or KV is determined according to ASTM D445 and values are assumed to be measured at 100° C. unless otherwise stated According to the invention, the liquid or bottoms product of the aforementioned integrated flash drum is mixed with SCT.

The SCT may be "fluxed" or diluted. Fluxes per se are known in the art. Preferred fluxes for the present invention include one or more of SCGO (Steam cracked Gas oil), ADO (Atmospheric/automotive diesel oil), HAGO (Heavy atmospheric gas oil), and HDO (Heavy diesel oil). The amount of flux to be used can be determined by one of ordinary skill in the art in possession of the present disclosure. Preferably about 5 to 35 wt % or 10 to 30 wt % or about 15 to 25 wt % of flux will be used, based on the weight of the SCT and flux combined. Other preferred ranges are from any of the aforementioned lower limits to any of the aforementioned higher limits, e.g, about 5 to about 25 wt % or about 15 to 35 wt %. Additional fluxant may be added to meet RSFO (regular sulfur fuel oil) or LSFO (low sulfur fuel oil) specifications, as necessary. Specifications for RSFO, LSFO, heavy fuel oils, Bunker fuels, and the like typically vary from jurisdiction to jurisdiction. Such specifications are generally known to the artisan and typically readily publicly available.

In a preferred embodiment, SCT is obtained as a product of a pyrolysis furnace wherein additional products include a vapor phase including ethylene, propylene, butenes, and a liquid phase comprising C5+ species, having a liquid product distilled in a primary fractionation step to yield an overheads comprising steam-cracked naphtha fraction (i.e., C5-C10 species) and steam cracked gas oil (SCGO) fraction (i.e., a boiling range of about 400° F. to 550° F., e.g., C10-C15/C17 species), and a bottoms fraction comprising SCT and having a boiling range above about 550° F., e.g., C15/17+ species).

The liquid or bottoms product of the aforementioned flash drum may be mixed in almost any reasonable proportions with SCT, optionally fluxed such as with SCGO or AGO, provided that asphaltenes are not precipitated. Preferred proportions are from about 30 wt %, or 40 wt %, or 45 wt %, to about 80 wt %, or 75 wt %, or 70 wt %, or 60 wt %, or 55 wt %, of the liquid or bottoms product of the aforementioned flash drum, with ranges from any of the aforementioned lower values to any of the aforementioned higher values also contemplated. The remainder of the composition is SCT (based on the composition consisting of liquid or bottoms product of the aforementioned flash drum and SCT). Thus, preferred proportions of SCT may also be given as from about 20 wt %, or 25 wt %, or 30 wt %, or 40 wt %, or 45 wt %, to about 70 wt %, or 60 wt %, or 55 wt %, of SCT, with ranges from any of the aforementioned lower values to any of the aforementioned higher values also contemplated. These proportions do not include fluxant and/or SCGO or AGO, but are based solely on SCT and bottoms of the integrated flash drum.

SCT thus compatibilize with the liquid or bottoms product of the aforementioned flash drum may be mixed in any proportions with additional materials, advantageously so that no asphaltenes precipitate.

In preferred embodiments, the aforementioned mixture is blended with heavy fuel oils and/or Bunker fuels. Typical specifications are provided below for an RSFO blend meeting the 380 centistoke (cSt) requirements for Fuel. Oil is given below. For a composition according to the present invention, the most important specifications (with regard to meeting the various specifications for published fuel oil requirements) are Kinematic Viscosity (KV), Specific Gravity (SG) and compatibility (e.g., one or both of the sediment criteria listed below); It is an important and surprising discovery of the present inventors that such specifications can be met for a mixture containing steam cracked tar.

One typical specification for a fuel oil is listed in Table 1.

TABLE 1

(RFSO) Standard Fuel Oil Specifications in Singapore (Platt's)

| Property | 380 cSt Fuel Oil |
|---|---|
| Sulfur Max | 4.0% |
| Kinematic Vis @50 deg C. Max [ASTM D445] | 380 cSt |
| SG @15 C. deg C. Max | 0.991 |
| Flash Point Min | 66° C. |
| Pour Point Max | 24° C. |
| Ash on a weight basis Max | 0.10% |
| Conradson Carbon Residue (CCR) Max | 18% |
| Vanadium Max | 200 ppm |
| Sodium Max | 100 ppm |
| Aluminium + Silicon Max | 80 ppm |
| Water by distillation volume Max | 0.50% |
| Sediment by extraction Max | 0.10% |
| Total existent sediment | 0.10% |

Yet another surprising discovery of the present inventors is that the blend according to the invention may be advantageously fluxed with stream cracked gas oil (SCGO). This is a great advantage of the present invention not the least of which because SCGO is another of the products of the pyrolysis furnace that is generally considered undesirable because of lack of end uses. In embodiments, if SCGO or AGO is unavailable, HAGO or HDO may be used as fluxant.

Experimental

The following examples are meant to illustrate and not limit the present invention. Numerous modifications and variations are possible and it is to be understood that within the scope of the appended claims, the invention may be practiced otherwise than as specifically described herein.

In the following examples, shown in Table 2 below, typical Bunker oil blends are set forth. The ingredients are blended by routine methods (the details of blending are not particularly critical and may be accomplished by one of ordinary skill in the art in possession of the present disclosure without more than routine experimentation).

The requirements of Bunker C blends are as follows: density <0.991 g/cc, KV (kinematic viscosity) at 50° C. of <180, sulfur content of <3.5 wt % (wt % based on the weight of the entire composition). "Sbn" and "In" terms are known in the art; see for instance WO 98/26026 A1. The term "fluxed Zafiro LSVTB" is the liquid phase of the aforementioned integrated flash drum using Zafiro crude as a feed, fluxed with SCGO (up to 30 wt % fluxant used, based on the weight of the material specified and the fluxant combined). SOP is Singapore Refinery Fuel Oil, with LSVTB designating the liquid phase of the aforementioned flash drum. HAGO is heavy atmospheric gas oil.

TABLE 2

| Wt % | | Density g/cc | SP KIV @ 50° C. | Sulfur Wt % | Sbn | In |
|---|---|---|---|---|---|---|
| 20% | unfluxed tar | 1.097 | 250 | 0.6 | 185 | 64-114 |
| 25% | Fluxed Zafiro LSVTB | 0.968 | 180 | 0.6 | 145 | 0 |
| 7% | unfluxed SOP LSVTB | 0.89 | 180 | 0.2 | 30 | 15 |
| 40% | SOP Fuel Oil | 0.98 | 180 | 4 | 90 | 48 |
| 8% | HAG0 | 0.89 | 1.75 | 0.5 | 24 | 0 |
| 100% | | 0.960 | 180 | 1.9 | 113.3 | 64-114 |
| Specs. | | | | | | |
| 25% | unfluxed tar | 1.097 | 250 | 0.6 | 185 | 64-114 |
| 15% | Fluxed Zafiro LSVTB | 0.968 | 180 | 0.6 | 145 | 0 |
| 7% | unfluxed SOP LSVTB | 0.89 | 180 | 0.2 | 30 | 15 |
| 40% | SOP Fuel Oil | 0.98 | 180 | 4 | 90 | 48 |
| 13% | HAG0 | 0.89 | 1.75 | 0.5 | 24 | 0 |
| 100% | | 0.989 | 174 | 1.9 | 109.2 | 64-114 |
| 5% | unfluxed tar | 1.097 | 250 | 0.6 | 185 | 64-114 |
| 50% | Fluxed Zafiro LSVTB | 0.968 | 180 | 0.6 | 145 | 0 |
| 0% | unfluxed SOP LSVTB | 0.89 | 180 | 0.2 | 30 | 15 |
| 40% | SOP Fuel Oil | 0.98 | 180 | 4 | 90 | 48 |
| 5% | HAG0 | 0.89 | 1.75 | 0.5 | 24 | 0 |
| 100% | | 0.975 | 1.75 | 2.0 | 119.0 | 64-114 |
| 25% | unfluxed tar | 1.097 | 250 | 0.6 | 185 | 64-114 |
| 25% | Fluxed Zafiro LSVTB | 0.968 | 180 | 0.6 | 145 | 0 |
| 0% | unfluxed SOP LSVTB | 0.89 | 180 | 0.2 | 30 | 15 |
| 40% | SOP Fuel Oil | 0.98 | 180 | 4 | 90 | 48 |
| 10% | HAG0 | 0.89 | 1.75 | 0.5 | 24 | 0 |
| 100% | | 0.997 | 180 | 2.0 | 120.9 | 64-114 |

As shown above in Table 2, SCT can be blended advantageously with fuel oils when blended with the bottoms product of an integrated flash drum.

When numerical lower limits and numerical upper limits are listed herein, ranges from any lower limit to any upper limit are contemplated. All patents and patent applications, test procedures (such as ASTM methods, UL methods, and the like), and other documents cited herein are incorporated by reference to the extent such disclosure is not inconsistent with this invention and for all jurisdictions in which such incorporation is permitted. Trade names used herein are indicated by a ™ symbol or ® symbol, indicating that the names may be protected by certain trademark rights, e.g., they may be registered trademarks in various jurisdictions The invention has been described above with reference to numerous embodiments and specific examples. Many variations will suggest themselves to those skilled in this art in light of the above detailed description. All such obvious variations are within the full intended scope of the appended claims.

What is claimed is:

1. An asphaltene-containing composition wherein the asphaltenes are not precipitated, comprising steam cracked tar (SCT) and the asphaltenes-containing bottoms product of a flash drum integrated with a pyrolysis furnace, wherein the composition contains proportions of steam cracked tar and bottoms product in amounts ranging from about 20 wt% to about 70 wt% steam cracked tar and about 30 wt% to about 80 wt% of the bottoms product.

2. The composition of claim 1, further comprising a fuel oil.

3. The composition of claim 1, wherein said SCT is fluxed.

4. The composition of claim 1, further comprising steam cracked gas oil.

5. The composition of claim 1, further comprising VGO.

6. The composition of claim 1, further comprising vacuum tower bottoms.

7. The composition of claim 1, wherein said SCT is derived from whole crude oil or a fraction thereof having a Pour Point of about less than 15° C. (ASTM D5853 or ASTM D97, respectively).

8. The composition of claim 1, wherein said SCT is derived from whole crude oil or a fraction thereof having a Pour Point of about less than 5° C. (ASTM D5853 or ASTM D97, respectively).

9. A fuel oil including the composition of claim 1.

10. The fuel oil of claim 9, wherein said fuel oil is a Bunker Fuel.

11. The fuel oil of claim 9, wherein said fuel oil is a regular sulfur fuel oil or low sulfur fuel oil.

12. The fuel oil of claim 9, wherein said bottoms product of a flash drum integrated with a pyrolysis furnace is the bottoms product resulting from feeding crude oil or a fraction thereof to said pyrolysis furnace.

13. The fuel oil of claim 9, further comprising at least one ingredient selected from steam cracked gas oil and atmospheric gas oil.

14. The fuel oil of claim 9, characterized by at least one of (i) a sediment by extraction maximum of 0.10 wt%, and (ii) a total existent sediment of 0.10 wt% or less.

15. An asphaltene-containing composition wherein the asphaltenes are not precipitated, consisting essentially of steam cracked tar (SCT) and the asphaltenes-containing bottoms product of a flash drum integrated with a pyrolysis furnace.

* * * * *